US005174646A

United States Patent [19]

Siminovitch et al.

[11] Patent Number: 5,174,646

[45] Date of Patent: Dec. 29, 1992

[54] HEAT TRANSFER ASSEMBLY FOR A FLUORESCENT LAMP AND FIXTURE

[75] Inventors: Michael J. Siminovitch, Richmond; Francis M. Rubenstein, Berkeley; Richard E. Whitman, Richmond, all of Calif.

[73] Assignee: The Regents of the University of California, Berkeley, Calif.

[21] Appl. No.: 626,563

[22] Filed: Dec. 6, 1990

[51] Int. Cl.[5] ..... F21V 29/00

[52] U.S. Cl. ..... 362/218; 362/216; 362/294; 362/373; 313/44; 313/45; 313/493

[58] Field of Search ..... 362/218, 216, 217, 294, 362/373, 377; 313/44, 45, 493

[56] References Cited

U.S. PATENT DOCUMENTS

| | | | |
|---|---|---|---|
| D. 126,854 | 4/1941 | McCann | 362/377 |
| 2,505,112 | 4/1950 | Hallman | 362/260 X |
| 2,966,602 | 12/1960 | Waymouth et al. | 313/44 |
| 3,112,890 | 12/1963 | Snelling | 362/373 |
| 3,965,345 | 6/1976 | Fordsmand | 362/218 |
| 3,974,418 | 8/1976 | Fridrich | 362/218 |
| 4,393,323 | 7/1983 | Hubner | 362/223 |
| 4,423,348 | 12/1983 | Greiler | 362/373 |

FOREIGN PATENT DOCUMENTS

| | | | |
|---|---|---|---|
| 1091233 | 10/1960 | Fed. Rep. of Germany | 362/216 |

*Primary Examiner*—Stephen F. Husar

*Attorney, Agent, or Firm*—Flehr, Hohbach, Test, Albritton & Herbert

[57] ABSTRACT

In a lighting fixture including a lamp and a housing, a heat transfer structure is disclosed for reducing the minimum lamp wall temperature of a fluorescent light bulb. The heat transfer structure, constructed of thermally conductive material, extends from inside the housing to outside the housing, transferring heat energy generated from a fluorescent light bulb to outside the housing where the heat energy is dissipated to the ambient air outside the housing. Also disclosed is a method for reducing minimum lamp wall temperatures. Further disclosed is an improved lighting fixture including a lamp, a housing and the aforementioned heat transfer structure.

21 Claims, 6 Drawing Sheets

HEAT TRANSFER ASSEMBLY FOR A FLUORESCENT LAMP AND FIXTURE

U.S. GOVERNMENT CONTRACTS

The invention described herein arose in the course of, or under, Contract No. DE-AC03-76SF00098 between the U.S. Department of Energy and the University of California for the operation of Lawrence Berkeley Laboratory.

BACKGROUND OF THE INVENTION

This invention relates to fluorescent lighting fixtures and particularly to methods for the cooling of lamps operating within such fixtures.

In an effort to conserve energy, limit pollution produced by electricity generating facilities and reduce costs to energy consumers, the use of fluorescent lamps instead of incandescent lamps is rapidly gaining acceptance for the lighting of commercial and residential interiors. To the same end, efforts have been made to improve on the efficiency of fluorescent lamps. Most efforts have focused on developing more efficacious lamps and ballasts and improved energy management. While the aforementioned efforts are often meritorious, often overlooked are methods for increasing the fixture efficiency.

Various methods for increasing fixture efficiency are known in the art. These are generally complex. Reference is made to the devices described in U.S. Pat. Nos. 3,112,890 and 3,869,606.

Other techniques for increasing efficiency focus on reducing the lamp wall temperature of a fluorescent bulb while a fluorescent bulb is housed inside fluorescent bulb fixture. This technology has developed since it is known that fluorescent lamps efficiency is highly sensitive to changes in minimum lamp wall temperature. For the standard F40 lamp/CBM (Certified Ballast Manufacturers) ballast system, light output is maximal at a MLWT of 37° C. (±1°), corresponding to an ambient temperature of 25° C. This is also the temperature condition at which manufacturers rate the lamp's lumen output.

To the end of reducing lamp wall temperatures, techniques include optimization of the thermal operating characteristics of a fluorescent lamp system. For example, techniques such as lamp compartment air flow fixtures and natural convention cooling of the lamp compartment have been developed. Also, described in U.S. patent application Ser. No. 07/516,767, filed Apr. 30, 1990, naming one of the applicants as inventor, is an invention directed to direct lamp spot cooling using thermoelectric and heat pipe devices. Reference is also made to an article by one of the instant inventors, Siminovitch, Michael, Energy Conservation from Thermally Efficient Fluorescent Fixtures, in *Strategic Planning and Energy Management,* Vol. 9, No. 3, 1990 for an overview of the research involved in the development of the invention described in the aforementioned patent application.

While the techniques discussed above address the optimization of thermal operating characteristics of a fluorescent lamp system, several of the systems described require that heat be transferred to and dissipated from a plenum located above the fluorescent lamp system. This further requires that the lamp system be mounted into a ceiling, or at least, be mounted so that the heat generated from the lamp be allowed access to the plenum above the ceiling.

The invention disclosed in U.S. patent application Ser. No. 07/516,767, as described above, is best suited for tube fluorescent light bulbs. However, compact fluorescent light bulbs are also commonly used in the lighting industry. Therefore, it is highly desirable to invent a thermally optimized fluorescent lamp system which, in its embodiment, is applicable to both tube fluorescent light bulbs and compact fluorescent light bulbs lamp systems.

It is also desirable, in an effort to optimize thermal operating characteristics of a lamp system, to be able to retrofit already existing lamp systems with a minimal expense of reconfiguration. It is further desirable to minimize costs of thermal optimization in new lamp systems.

SUMMARY OF THE INVENTION

In light of the foregoing problems, it is an object of this invention to provide an improvement in light output and efficiency of a fluorescent light bulb housed within a housing.

It is a further object of this invention to provide a thermally optimized lamp system which does not require that the lamp system be mounted in a ceiling or does not require that there be access to plenum above that ceiling for purposes of ventilation of dissipating heat energy.

It is also an object of this invention to provide for use of the invention in both tube and compact fluorescent light bulbs, as well as other types of fluorescent bulbs.

It is another object of this invention to optimize thermal operating characteristics without the expense of significant reconfiguration of an existing or new lamp system.

In accordance with the aforementioned objectives, this invention provides an improved efficiency fluorescent lamp and fixture having a heat transfer assembly which transfers heat generated by the fluorescent light bulb housed inside a housing to the ambient air outside the housing where the heat energy is dissipated by heat transfer to the ambient air. A thermally conductive material is configured to be in thermal contact with the light bulb and to operate as a heat exchanger between the light bulb and the ambient air outside the housing. Although the thermally conductive material may be positioned outside the housing in the path of the light generated, the thermally conductive material is configured to minimize obstruction of light traveling from inside the housing to outside the housing.

DETAILED DESCRIPTION OF THE PREFERRED EMBODIMENTS

FIGS. 1 through 10 illustrate the preferred embodiments of the instant invention, specifically with respect to compact and tube fluorescent light bulbs and their fixtures. The method claimed which is described hereafter, for improving light output and efficacy of these types of fluorescent light bulbs is also applicable to any type of fluorescent light bulbs. Light output and efficiency of fluorescent light bulbs are determined by the vapor pressure within the lamp. The vapor pressure varies as a function of a minimum lamp wall temperature.

Figure 1:
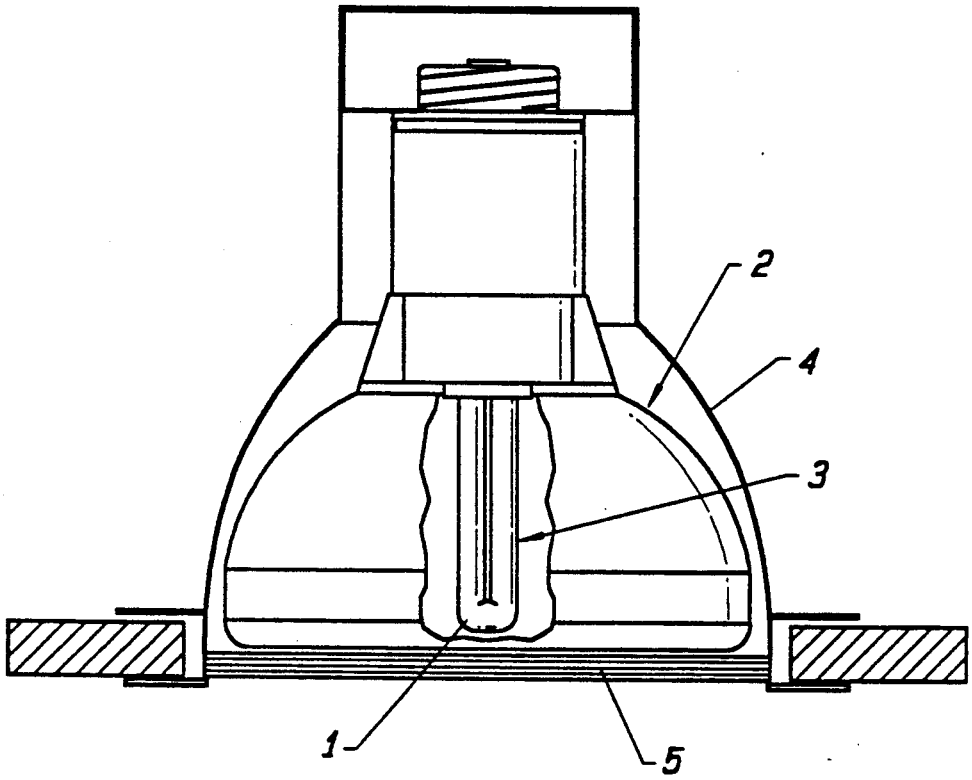
FIG. 1 PRIOR ART
FIG. 1 is a side view of a compact fluorescent bulb within a reflector housing, mounted within a down light fixture, such fixture shown as a recessed ceiling mounted fixture.

FIG. 1 shows a compact fluorescent bulb 1 within reflector housing 2, wherein lamp wall 3 encloses the gases that make up the fluorescent bulb 1. The bulb 1 is housed within reflector housing 2, and reflector housing 2 is further housed within down light fixture 4 having a lens cover 5. The enclosure of bulb 1 within reflector housing 2 housed within the fixture 4 results in the overheating of bulb 1. The overheating of bulb 1 is due to heat trapped in the reflector housing and in the space between the reflector 2 and fixture 4 fixture 4. Heat is trapped, particularly when the down light fixture and reflector do not provide means for air flow and natural convection cooling of the lamp compartment. These elevated temperatures raise the minimum lamp wall temperature of the fluorescent bulb 1 and correspondingly raise the vapor pressure of the gases within the bulb 1, whereby the light output and efficiency characteristics of the bulb 1 are reduced.

Figure 2:
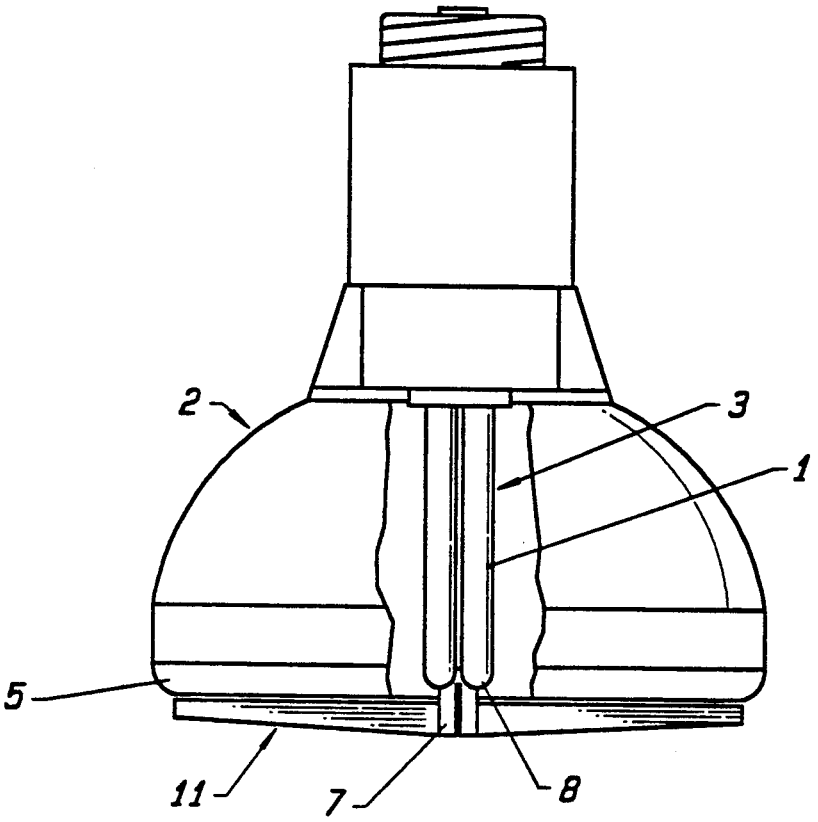
FIG. 2 is a side view of a compact fluorescent bulb within a reflector housing with thermally conductive material in thermal contact with the compact fluorescent bulb and the ambient air outside the housing.
Figure 4:
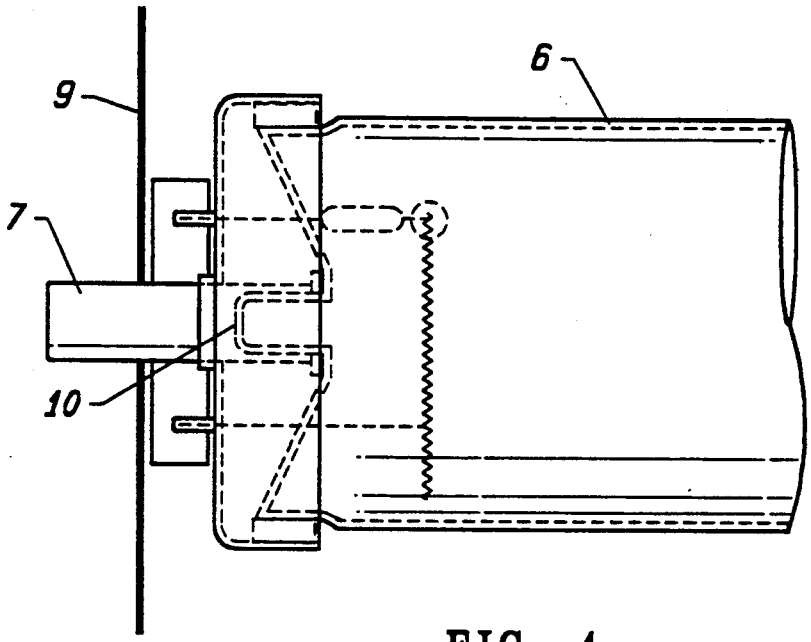
FIG. 4 is a side view of a tube fluorescent bulb with thermally conductive material in thermal contact with the tube bulb and where the thermally conductive material is extended beyond the outer surface of the housing, such material configured as a thermal pillar.

A lowering of the temperature of a small area of the lamp wall 3 is effective to remedy the overheating of a compact fluorescent light bulb 1 as shown in FIG. 2 or a tube fluorescent light bulb 6 as shown in FIG. 4. FIG. 2 and FIG. 4 are illustrative of lamp wall cooling assemblies. FIG. 2 shows an embodiment of this invention in conjunction with a compact fluorescent light bulb 1 whereas FIG. 4 shows an embodiment of this invention in conjunction with a tube fluorescent light bulb 6. In each case, the lowering of the lamp wall temperature is accomplished by transferring heat energy generated from a fluorescent light bulb to outside its housing and then dissipating the heat energy transferred to the surrounds such as ambient air outside the housing. This is accomplished by transferring heat primarily by thermal conduction from bulb 1 or bulb 6 to extended surfaces of a heat transfer structure which transfers the heat to the surroundings by convection, conduction and radiation. As shown in FIG. 2, thermal conductive means 7 is placed in thermal contact with a limited area of the light bulb 1 which conducts the heat outwardly to outside the reflector housing 2, and thereafter dissipates the heat to the ambient air outside the housing from its large surface area. The wall temperature of the light bulb 1 is thereby reduced.

When the temperature has stabilized to its peak performance level, the vapor pressure is lower and mercury gas is allowed to condense at the coldest spot in the light bulb, producing grayish particles. This phenomenon is known as a "mercury coldspot." Evidence that the embodiment of this invention is effective can be seen at the point of contact 8 of the thermally conductive material 7 with the fluorescent light bulb 1. By inspecting the fluorescent light bulb 1 at the aforementioned point of contact, grayish particles accumulated within the bulb 1 can be observed.

The heat transfer structure 7 can be a metal or metals, a gas or a liquid enclosed within a vessel, or a combination thereof. The only criteria for the type of thermally conductive material or structure used is that it be amenable to a configuration which allows it to be in thermal contact with the light bulb and therefore provide a large surface area for heat transfer from the light bulb through the conducting material to a point outside of the housing. The transferring of the heat is effected by any method of transferring heat energy, including but not limited to radiation, convection and conduction.

Once the heat energy has been transferred to outside the housing 2, the heat energy is dissipated into the ambient air. Dissipation of the heat energy into the ambient air is effected by any method of dissipating heat energy, including but not limited to radiation, convention and conduction. Furthermore, it is necessary that thermally conductive material 7 outside housing 2 has sufficient surface area so that in combination with its physical configuration it may act as a heat exchanger, thereby dissipating the heat energy.

It is not necessary that heat transfer structure be constructed of a single piece. It may be equally or more effective to construct thermally conductive material 7 of two or more pieces with one piece providing good thermal contact with the bulb surface and another good heat transfer.

While the above description has been mostly in the context of FIG. 2, the same discussion also holds true for FIG. 4, wherein a tube fluorescent light bulb lamp wall temperature is lowered by placing the bulb 6 in thermal contact with thermally conductive material 7 and transferring the heat energy to outside the fixture 9 where it is dissipated into the ambient air. In this embodiment, the point of thermal contact 10 is at the end of the tube fluorescent light bulb, however, this is not necessarily the only efficient point of contact. Critical however, is that the transferring means provide for transfer of heat energy to outside the housing 9 where the heat dissipates into the ambient air.

Figure 3:
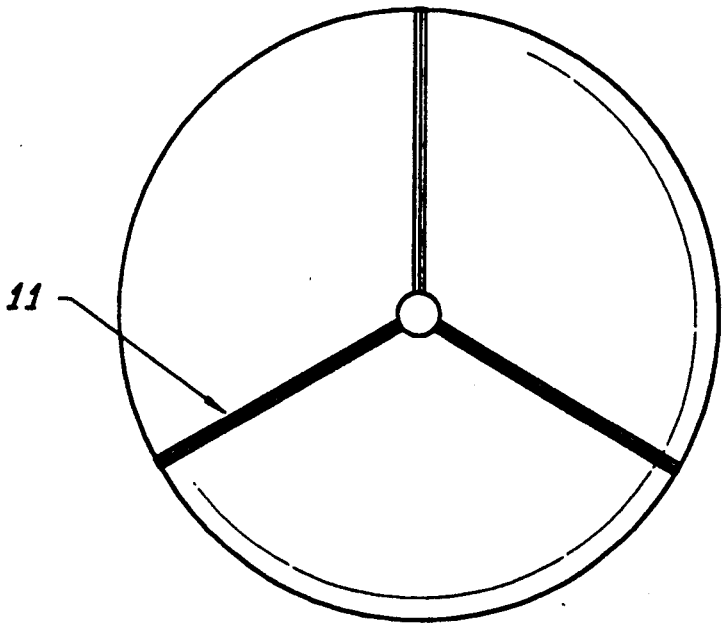
FIG. 3 is a plan view of thermally conductive material extended beyond the housing, such material configured in radially extending fins.

FIG. 2 shows the thermally conductive material 7 placed in the path of light emanating from the light opening of the reflective housing 2. As shown in FIG. 3, thermally conductive material 7 is configured to minimize obstruction of light traveling on its path to outside the housing 2. In this embodiment, the thermally conductive material 7 is configured as radially extending fins 11. However, other configurations may provide ample surface area as well and still minimize obstruction of light traveling on its path to outside the housing 2. For example, a single or plurality of squares, rectangles or circles formed of thermally conductive material supported by one or more radiating fins, or a thermal pillar protruding beyond the housing 2, are also effective shapes for the thermally conductive material outside the housing 2.

Figure 5:
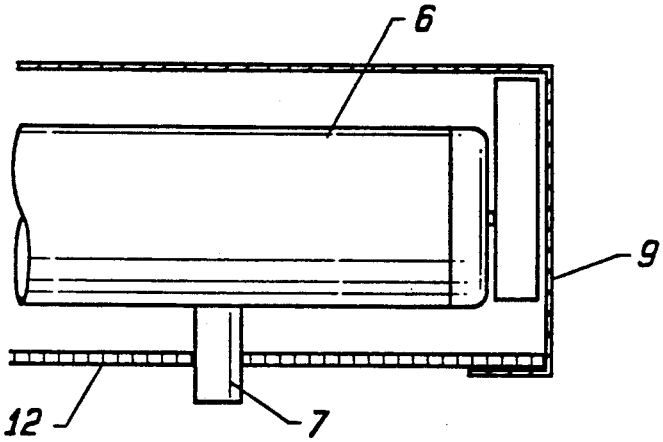
FIG. 5 is a side view of a tube fluorescent bulb within a fixture where the thermally conductive material is in the path of the light emanating from the fixture with minimal obstruction of the light.
Figure 6:
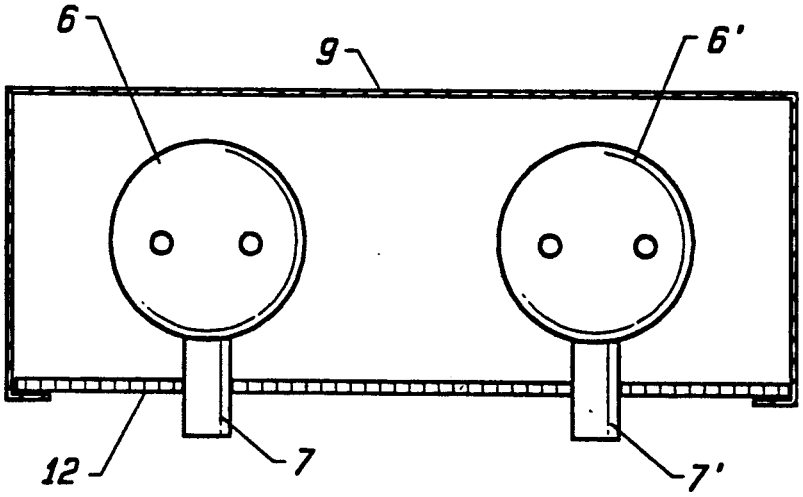
FIG. 6 is a cross sectional view of a tube fluorescent light fixture with two such fluorescent bulbs where the thermally conductive material is in the path of the light emanating from the fixture with minimal obstruction of the light.

FIG. 4 illustrates similar principles as described in the preceding paragraph for the configuration of the thermally conductive material 7 outside the fixture 9. In the preferred embodiment, the thermally conductive material is configured as a thermal pillar which is not in the path of the light emanating from the fixture 9. However, FIGS. 5 and 6 show a configuration in which thermally conductive material 7 and 7' passes through a lens cover 12 and is in the path of the light emanating from the fixture 9 but which allows light to pass from bulbs 6 and 6' with minimal obstruction from the thermally conductive material 7 and 7'.

Figure 7:
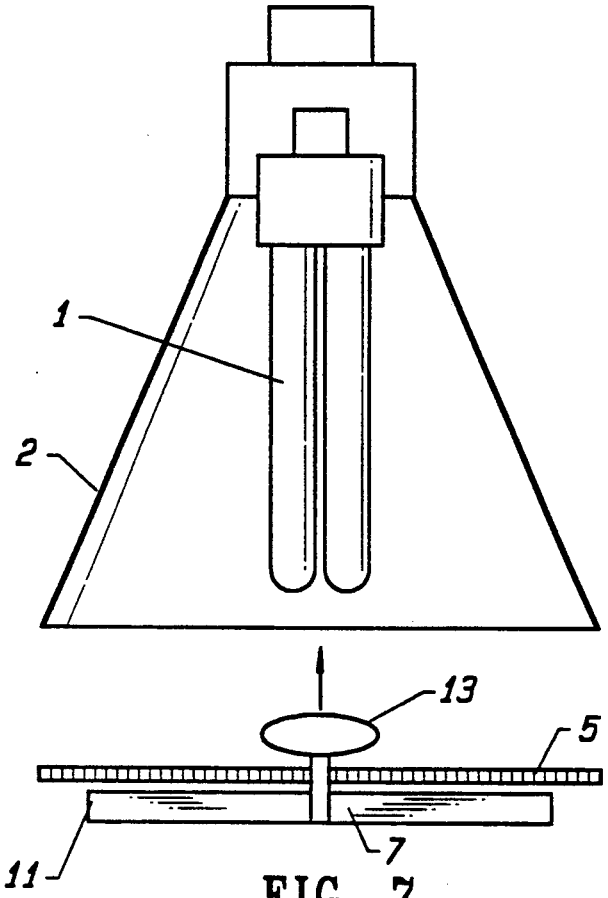
FIG. 7 depicts a spring contact before contact is made with a compact fluorescent light bulb.
Figure 8:
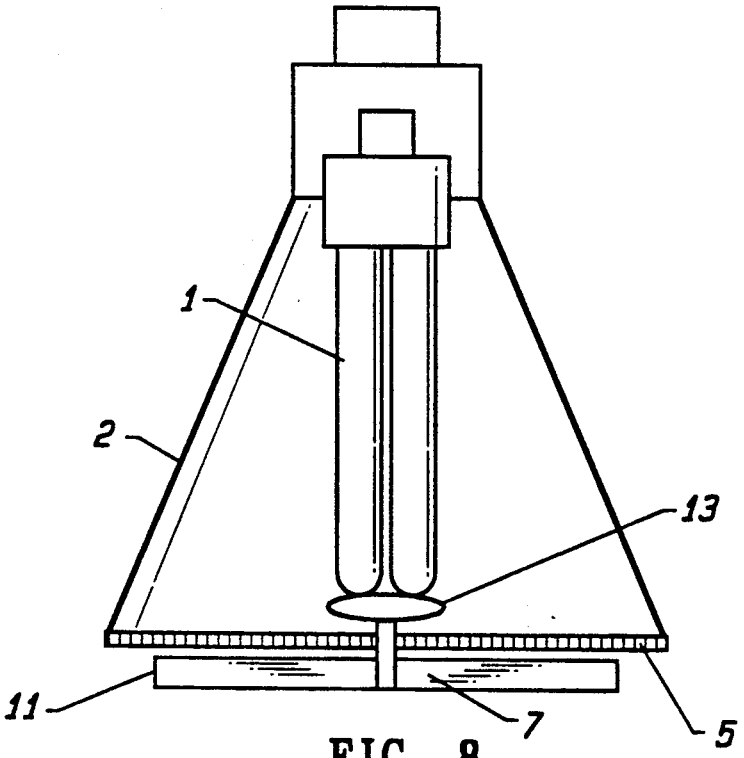
FIG. 8 shows the spring contact of FIG. 7 after contact has been made.

FIGS. 7 and 8 depict yet another embodiment of the instant invention. Reflector housing 2 may be equipped with a removable transparent lens 5 with conductive material 7 attached to and passing through the lens 5. The advantage to this configuration is that conductive material 7 may come into contact with compact bulb 1 in a temporary manner, that is, they need not be permanently attached to one another. This configuration allows for easy installation and removal of the compact bulb 1. FIG. 7 shows spring contact 13 before its contact is made with bulb 2. As the lens cover 5 is positioned on reflector housing 2, spring contact 13 comes into contact with compact bulb 1, essentially snapping into the contact position. FIG. 8 shows that contact having been made.

Figure 9:
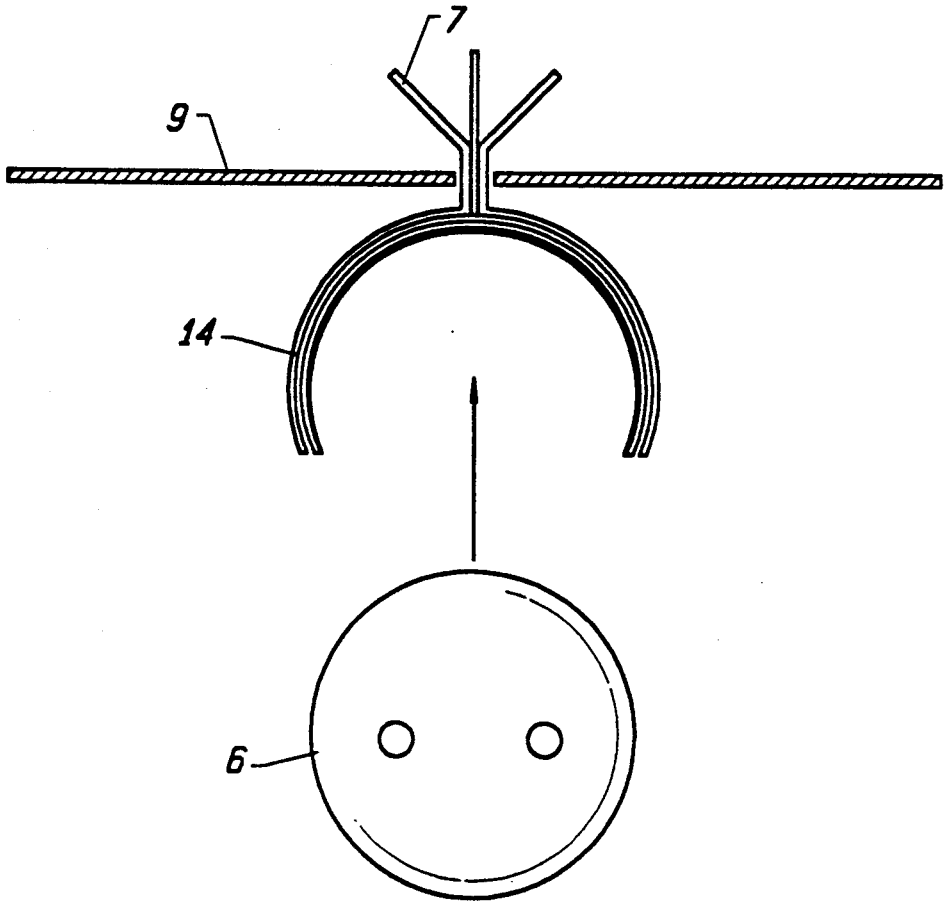
FIG. 9 depicts a tube fluorescent light bulb before it has made contact with a conductive member spring contact.
Figure 10:
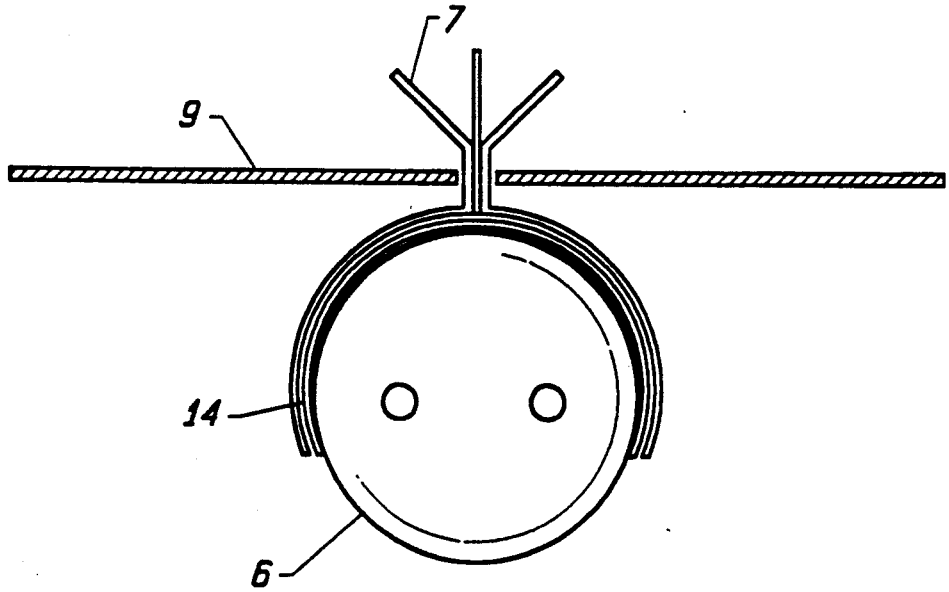
FIG. 10 shows the conductive member spring contact of FIG. 8 after contact has been made.

FIGS. 9 and 10 likewise show a reflector housing 9 with conductive material 7 attached to and passing through the reflector housing 9 such that tube bulb 6 may come into contact with conductive material 7 in a temporary manner. Conductive member spring contact 14, which is a portion of conductive material 7, allows tube bulb 6 to snap into position for adequate contact. FIG. 9 shows tube bulb 6 before it has made contact with conductive member spring contact 14. FIG. 10 shows that contact having been made. The conductive material 7 instead may be attached to a lens cover 12 of the tube bulb reflector housing 9 as shown in FIGS. 6 and 7 in the same manner as depicted in FIGS. 7 and 8.

Figure 11:
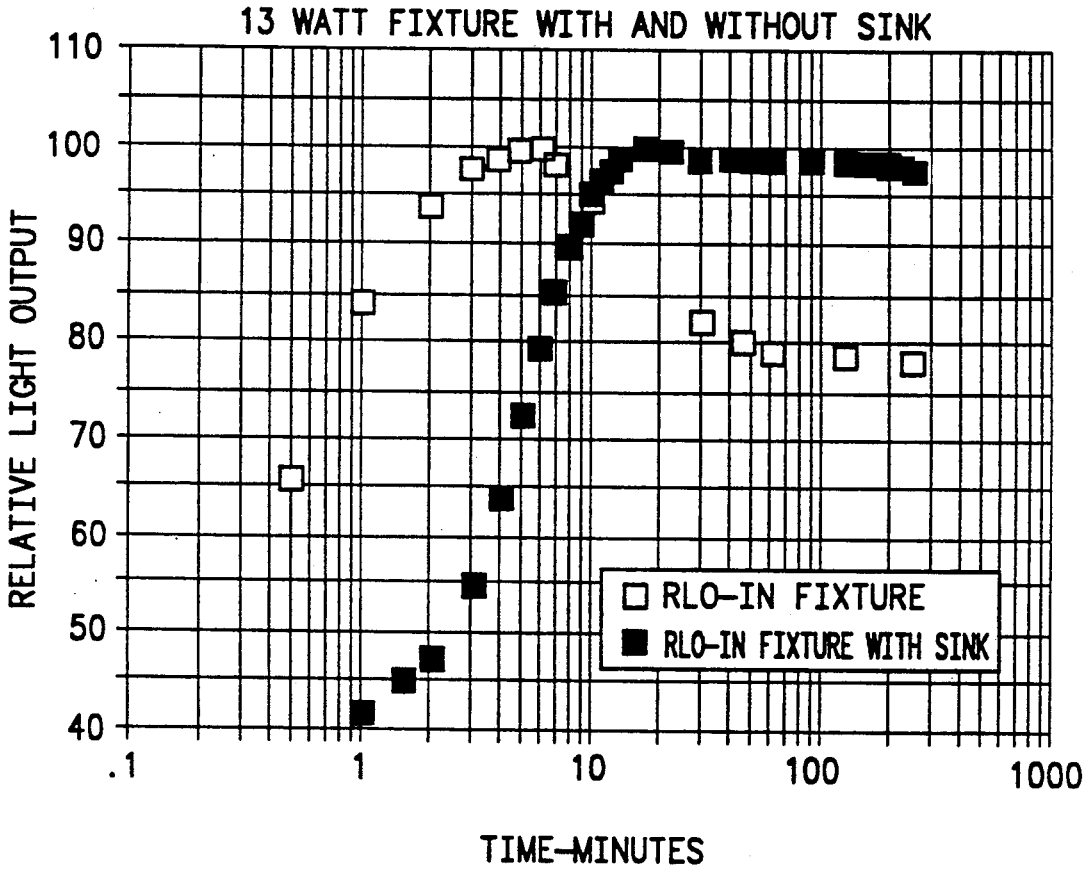
FIG. 11 is a graph mapping the relative light output verses time in minutes of a compact fluorescent bulb in a housing both, with and without a thermally conductive material acting as a heat sink.

The advantages of the instant invention can be see by inspecting FIG. 11 which maps relative light output verses time in minutes. The white dots indicate a 13 watt compact fluorescent light bulb in a reflective housing within a recessed down light fixture without a heat sink, as shown in FIG. 1. The black dots indicate a 13 watt compact fluorescent light bulb similarly situated except that it employs the above described radial fin system. A log scale for time on the x-axis is used in order to illustrate more clearly the variations that occur over time. The y-axis shows relative light output for both configurations expressed as a function of the maximum output from the lamp system in the fixture.

Maximum light output is achieved shortly after the fixture is energized (usually 10–15 minutes). Thereafter the light outputs starts to diminish due to increasing lamp wall temperatures. The light output of a light system without a heat sink is ultimately reduced by approximately 20%. Although the light system with the radial fin system reaches a maximum more slowly than does the its counterpart without a heat sink, the cooled light system has maintained 98–99% of its optimum light output after four hours of operation. This level of efficiency is consistent after extended use as well.

Although the invention has been described in connection with preferred embodiments thereof, it would be appreciated by those skilled in the art that various modifications and changes can be made. It is therefore intended that the coverage afforded applicant be limited only by the claims and their equivalents.

It is claimed:

1. An apparatus for improving the light output and efficiency of a fluorescent light bulb housed within a housing having a light opening comprising:

a heat transfer structure independent of said housing, for transferring heat energy generated from said fluorescent light bulb through said heat transfer structure to outside said housing where said heat energy is dissipated into the surrounds.

2. An apparatus as recited in claim 1 wherein said means for transferring said heat energy to outside said housing includes thermally conductive material adapted to be in thermal contact with a fluorescent light bulb.

3. An apparatus as recited in claim 1 wherein said means for transferring heat energy includes thermally conductive material outside said housing, said thermally conductive material having sufficient surface area exterior to said housing configured to operated as a heat exchanger thereat.

4. An apparatus as recited in claim 1 wherein said heat transfer structure includes of two or more portions.

5. An apparatus as recited in claim 3 wherein said fluorescent light bulb is a compact fluorescent light bulb and wherein said thermally conductive material outside said housing is positioned outside said housing in the path of light emanating from said light opening.

6. An apparatus as recited in claim 5 wherein said thermally conductive material positioned outside said housing is configured to minimize obstruction of light traveling thereon said path.

7. An apparatus as recited in claim 5 wherein said thermally conductive material outside said housing is radially extending fins.

8. An apparatus as recited in claim 3 wherein said fluorescent light bulb is a tube fluorescent light bulb and wherein said thermally conductive material outside said housing extends beyond the outer surface of said housing.

9. An apparatus as recited in claim 8 wherein said thermally conductive material outside said housing is a thermal pillar.

10. An apparatus as recited in claim 8 wherein said wherein said thermally conductive material outside said housing is positioned outside said housing in the path of light emanating from said light opening.

11. An apparatus as recited in claim 10 wherein said thermally conductive material positioned outside said housing is configured to minimize obstruction of light traveling thereon said path.

12. In a compact fluorescent light fixture including a compact fluorescent light bulb housed within a housing, an improvement for maintaining a lower minimum lamp wall temperature of said compact fluorescent light fixture, wherein the improvement comprises:

a heat transfer structure independent of said housing, for transferring heat energy generated from said fluorescent light bulb through said heat transfer structure to outside said housing where said heat energy is dissipated into the surrounds.

13. In a tube fluorescent light fixture including a tube fluorescent light bulb housed within a housing, an improvement for maintaining a lower minimum lamp wall temperature of said tube fluorescent light fixture, wherein the improvement comprises:

a heat transfer structure extending from inside said housing to outside said housing; and heat transfer means, independent of said housing, for transferring heat energy generated from said fluorescent light bulb through said heat transfer structure to outside said housing where said heat energy is dissipated into ambient air outside said housing.

14. A method for improving the light output and efficacy of a fluorescent light bulb housed within a housing having a light opening comprising:

transferring heat energy generated by said compact fluorescent light bulb primarily by conduction from a surface area of said bulb to outside said housing; and thereafter dissipating said transferred heat energy to the surrounds from a larger surface area.

15. A method as recited in claim 14 wherein said step of transferring heat energy generated by said fluorescent light bulb to outside said housing includes said contacting fluorescent light bulb with thermally conductive material.

16. A method as recited in claim 15 wherein said step of dissipating said transferred heat energy to ambient air outside of said housing includes contacting said thermally conductive material with ambient air outside said housing.

17. A method as recited in claim 16 further comprising:

positioning thermally conductive material outside said housing in the path of light emanating from said light opening; and configuring thermally conductive material to minimize obstruction of light traveling thereon said path.

18. An apparatus as recited in claim 1 wherein said heat transfer structure is springably mountable onto said fluorescent light bulb.

19. An apparatus as recited in claim 12 wherein said heat transfer structure is springably mountable onto said fluorescent light bulb.

20. An apparatus as recited in claim 13 wherein said heat transfer structure is springably mountable onto said fluorescent light bulb.

21. An apparatus as recited in claim 14 further comprising the step of springably mounting said heat transfer structure onto said fluorescent light bulb.

* * * * *